US009240173B2

(12) United States Patent
Takasaki

(10) Patent No.: US 9,240,173 B2
(45) Date of Patent: Jan. 19, 2016

(54) SOUND SOURCE CONTROL INFORMATION GENERATING APPARATUS, ELECTRONIC PERCUSSION INSTRUMENT, AND SOUND SOURCE CONTROL INFORMATION GENERATING METHOD

(71) Applicant: ROLAND CORPORATION, Shizuoka (JP)

(72) Inventor: Ryo Takasaki, Shizuoka (JP)

(73) Assignee: ROLAND CORPORATION, Shizuoka (JP)

( * ) Notice: Subject to any disclaimer, the term of this patent is extended or adjusted under 35 U.S.C. 154(b) by 0 days.

(21) Appl. No.: 14/470,944

(22) Filed: Aug. 28, 2014

(65) Prior Publication Data

US 2015/0059559 A1 Mar. 5, 2015

(30) Foreign Application Priority Data

Sep. 5, 2013 (JP) ..... 2013-183910

(51) Int. Cl.
*G10D 13/02* (2006.01)
*G10H 1/00* (2006.01)
(Continued)

(52) U.S. Cl.
CPC ..... *G10H 3/146* (2013.01); *G10D 13/02* (2013.01); *G10D 13/024* (2013.01); *G10H 1/00* (2013.01); *G10H 1/02* (2013.01); *G10H 3/00* (2013.01); *G10H 3/14* (2013.01); *G10H 3/143* (2013.01);
(Continued)

(58) Field of Classification Search
CPC ..... G10H 1/00; G10H 1/02; G10H 3/00; G10H 3/14; G10H 3/146; G10H 3/143; G10H 7/00; G10D 13/02; G10D 13/024
USPC ..... 84/615, 730
See application file for complete search history.

(56) References Cited

U.S. PATENT DOCUMENTS 4,479,412 A * 10/1984 Klynas ..... G10H 3/143 84/730
5,095,433 A * 3/1992 Botarelli ..... F41J 5/056 235/400
(Continued)

FOREIGN PATENT DOCUMENTS

EP 0997862 5/2000
JP 2001-255871 9/2001

OTHER PUBLICATIONS

"Search Report of European Counterpart Application", issued on Feb. 3, 2015, p. 1-p. 4, in which the listed references were cited.

*Primary Examiner* — David Warren
*Assistant Examiner* — Christina Schreiber
(74) *Attorney, Agent, or Firm* — Jianq Chyun IP Office

(57) ABSTRACT

A sound source control information generating apparatus, an electronic percussion instrument, and a sound source control information generating method, adapted for preventing generation of an unintended sound caused by a rebound of an object placed on one struck head, are provided. According to the present invention, if a first output value with respect to one struck head is obtained, the one struck head serves as a target struck head, and information is generated for controlling a sound source means such that a sound generation process performed by the sound source means differs according to whether the first output value obtained with respect to the target struck head or a value corresponding to the first output value is greater than a predetermined threshold value.

20 Claims, 7 Drawing Sheets

(51) Int. Cl.

| | |
|---|---|
| ***G10H 1/02*** | (2006.01) |
| ***G10H 3/00*** | (2006.01) |
| ***G10H 3/14*** | (2006.01) |
| ***G10H 7/00*** | (2006.01) |

(52) U.S. Cl.
CPC ..... *G10H 7/00* (2013.01); *G10H 2220/561* (2013.01)

(56) References Cited

U.S. PATENT DOCUMENTS 5,336,959 A * 8/1994 Park ..... H02N 2/183 310/328
5,438,529 A * 8/1995 Rosenberg ..... G06F 3/0395 702/138
6,075,197 A * 6/2000 Chan ..... G10H 1/0008 84/730
6,326,539 B1 * 12/2001 Mishima ..... G10H 3/14 36/139
D455,774 S * 4/2002 Senda ..... D17/22
6,601,436 B1 * 8/2003 Senda ..... G10H 3/146 73/12.09
6,815,602 B2 * 11/2004 De Franco ..... G10H 3/146 84/730
7,405,353 B2 * 7/2008 Kiyono ..... A63F 13/06 84/411 R
7,446,254 B2 * 11/2008 Lee ..... G10H 1/46 84/411 R
8,121,300 B1 * 2/2012 LoDuca ..... G10H 1/22 381/118
8,148,617 B2 * 4/2012 Hashimoto ..... G10D 13/029 84/411 P
8,198,526 B2 * 6/2012 Izen ..... G10H 3/146 84/743
8,549,892 B2 * 10/2013 Weber ..... G01P 15/0891 73/12.01
2005/0262991 A1 * 12/2005 Arimoto ..... G10H 1/06 84/735
2006/0011050 A1 * 1/2006 Arimoto ..... G10H 1/0008 84/737
2008/0034946 A1 * 2/2008 Aimi ..... G10H 3/146 84/604
2008/0238448 A1 * 10/2008 Moore ..... G10H 3/10 324/686
2010/0326258 A1 * 12/2010 Masaki ..... G10H 1/16 84/730
2013/0098224 A1 * 4/2013 Takasaki ..... A63J 17/00 84/464 R
2013/0180335 A1 * 7/2013 Susami ..... G01H 1/12 73/579
2015/0059559 A1 * 3/2015 Takasaki ..... G10H 3/143 84/615
2015/0090101 A1 * 4/2015 Takasaki ..... G10H 3/146 84/626

* cited by examiner

SOUND SOURCE CONTROL INFORMATION GENERATING APPARATUS, ELECTRONIC PERCUSSION INSTRUMENT, AND SOUND SOURCE CONTROL INFORMATION GENERATING METHOD

CROSS-REFERENCE TO RELATED APPLICATION

This application claims the priority benefit of Japan application serial no. 2013-183910, filed on Sep. 5, 2013. The entirety of the above-mentioned patent application is hereby incorporated by reference herein and made a part of this specification.

BACKGROUND OF THE INVENTION

1. Field of the Invention

The present invention relates to a sound source control information generating apparatus and particularly relates to a sound source control information generating apparatus, an electronic percussion instrument, and a sound source control information generating method adapted for preventing generation of an unintended sound caused by a rebound of an object placed on one of multiple struck heads.

2. Description of Related Art

Japanese Patent Publication No. 2001-255871 discloses an electronic percussion instrument having a struck head that is divided into four portions. When one struck head is struck, the electronic percussion instrument generates a sound responsive to the stroke with use of a pressure sensor disposed on a back side of each struck head and a piezoelectric sensor disposed on a back side of a case.

PRIOR ART LITERATURE

Patent Literature

[Patent Literature 1] Japanese Patent Publication No. 2001-255871

In the case of using the electronic percussion instrument of Japanese Patent Publication No. 2001-255871, while a hand is placed on one struck head, if another struck head is struck, the hand may rebound on the one struck head due to the vibration transmitted from the another struck head that has been struck, and vibration caused by striking of the rebound on the one struck head may result in a sound that the player does not intend to make.

SUMMARY OF THE INVENTION

In view of the above, the present invention is directed to providing a sound source control information generating apparatus, an electronic percussion instrument, and a sound source control information generating method adapted for preventing generation of an unintended sound caused by a rebound of an object placed on one struck head.

In order to achieve the above, according to a sound source control information generating apparatus of an embodiment of the present invention, if a first output value with respect to one struck head is obtained, the one struck head serves as a target struck head, and information is generated for controlling a sound source means such that a sound generation process performed by the sound source means differs according to whether the first output value obtained with respect to the target struck head or a value corresponding to the first output value is greater than a predetermined threshold value. The first output value is an output value of a sensor capable of detecting striking on each of a plurality of struck heads, and a second output value is an output value of a sensor capable of detecting a state that an object is placed on each of the struck heads. Here, if the second output value, equal to or greater than a predetermined value, is obtained at least over a predetermined time before a timing of obtaining the first output value, a reference value or a value different from the reference value is used as the predetermined threshold value.

The condition that the second output value, equal to or greater than the predetermined value, is obtained over a first period before the timing of obtaining the first output value can infer striking based on the rebound of the object placed on the target struck head, namely, a condition that the target struck head vibrates in a state when the object, such as a hand, is placed on the target struck head. In such a case, the value different from the reference value is used as the predetermined threshold value, and therefore, the sound generation based on the striking vibration of the rebound of the object placed on the target struck head, which the player does not intend to make, can be prevented.

In the claims, the "sensor capable of detecting striking on each of a plurality of struck heads" and the "sensor capable of detecting a state that an object is placed on each of the struck heads" may be the same sensor or different sensors.

In addition to the effects achieved by the above embodiment 1, the sound source control information generating apparatus according to another embodiment 2 of the present invention further achieves the following effects. A ratio of the first output value obtained with respect to the other struck heads, other than the target struck head, to the first output value obtained with respect to the target struck head, or a difference obtained by subtracting the first output value obtained with respect to the target struck head from the first output value obtained with respect to the other struck heads, other than the target struck head, is compared with a first threshold value that is provided for comparison with the ratio or the difference. Since the degree of influence of the crosstalk that the vibration of the other struck heads causes to the vibration of the target struck head is differentiated by whether the object is placed on the target struck head or not, the influence of the crosstalk can be properly determined and the sound generation based on the striking vibration due to the rebound of the object placed on the target struck head can be properly controlled.

In addition to the effects achieved by the above embodiment 2, the sound source control information generating apparatus according to another embodiment 3 of the present invention further achieves the following effects. The information for controlling the sound source means is generated not only considering the comparison between the ratio or the difference and the first threshold value but also considering the comparison between the first output value obtained with respect to the target struck head and a second threshold value that is provided for comparison with the first output value. Based on whether the object is placed on the target struck head or not, the influence of the crosstalk can be properly determined, and what is more, striking vibration caused by noise or a small rebound can be properly eliminated. Thus, the sound generation based on the striking vibration due to the rebound of the object placed on the target struck head can be properly controlled.

In addition to the effects achieved by the above embodiment 1, the sound source control information generating apparatus according to another embodiment 4 of the present invention further achieves the following effects. The first output value obtained with respect to the target struck head is compared with a threshold value that serves as the predetermined threshold value for comparison with the first output value. Since the threshold value to be compared with the first output value is differentiated by whether the object is placed on the target struck head or not, the striking vibration caused by noise or a small rebound can be properly eliminated, and the sound generation based on the striking vibration due to the rebound of the object placed on the target struck head can be properly controlled.

In addition to the effects achieved by the above embodiments 1 to 4, the sound source control information generating apparatus according to another embodiment 5 of the present invention further achieves the following effects. The sound generation process is performed by the sound source means if the first output value obtained with respect to the target struck head or the value corresponding to the first output value is greater than the predetermined threshold value; and the sound generation process is not performed by the sound source means if the first output value or the value corresponding to the first output value is equal to or less than the predetermined threshold value. Thus, the sound generation based on the striking vibration due to the rebound of the object placed on the target struck head, which the player does not intend to make, can be prevented.

In addition to the effects achieved by the above embodiments 1 to 4, the sound source control information generating apparatus according to another embodiment 6 of the present invention further achieves the following effects. If the first output value obtained with respect to the target struck head or the value corresponding to the first output value is equal to or less than the predetermined threshold value, the sound generation process is performed by the sound source means at a smaller level in comparison with the case where the first output value or the value corresponding to the first output value is greater than the predetermined threshold value. Thus, the sound generation based on the striking vibration due to the rebound of the object placed on the target struck head, which the player does not intend to make, can be prevented.

In addition to the effects achieved by any of the above embodiments 1 to 6, the sound source control information generating apparatus according to another embodiment 7 of the present invention further achieves the following effects. If it is determined that the second output value, equal to or greater than the predetermined value, is obtained over the first period, a setting for using the value different from the reference value as the predetermined threshold value is performed for the struck head which is a target of the determination. With the setting, the sound generation based on the striking vibration due to the rebound of the object placed on the target struck head can be properly performed.

In addition to the effects achieved by the above embodiment 7, the sound source control information generating apparatus according to another embodiment 8 of the present invention further achieves the following effects. If it is determined that the second output value, less than the predetermined value, is obtained over the second period which is the same as or different from the first period, the setting for using the value different from the reference value as the predetermined threshold value for the struck head which is the target of the determination is canceled. Therefore, despite that the object placed on the struck head rebounds, the setting for using the value different from the reference value is maintained even if the second output value suddenly becomes less than the predetermined value, and thus it is possible to prevent using an inappropriate value as the predetermined threshold value.

In addition to the effects achieved by any of the above embodiments 1 to 6, the sound source control information generating apparatus according to another embodiment 9 of the present invention further achieves the following effects. The second output value obtained with respect to a part of or all of the struck heads is stored in a memory means over a predetermined memory period, which is at least the first period. If the second output value, equal to or greater than the predetermined value, is obtained over the first period before the timing that the first output value is obtained, based on the second output value stored in the memory means with respect to the target struck head, when the first output value with respect to the target struck head is obtained, the setting for using the value different from the reference value as the predetermined threshold value is performed for the target struck head. With the setting, the sound generation based on the striking vibration due to the rebound of the object placed on the target struck head can be properly performed.

In addition to the effects achieved by the above embodiment 9, the sound source control information generating apparatus according to another embodiment 10 of the present invention further achieves the following effects. If the second output value, less than the predetermined value, is obtained over the second period before the timing that the first output value is obtained, based on the second output value stored in the memory means with respect to the target struck head, when the first output value with respect to the target struck head is obtained, the setting for using the value different from the reference value as the predetermined threshold value for the target struck head is canceled, wherein the second period is equal to or less than the predetermined memory period and is the same as or different from the first period. Therefore, despite that the object placed on the struck head rebounds, the setting for using the value different from the reference value is maintained even if the second output value suddenly becomes less than the predetermined value, and thus it is possible to prevent using an inappropriate value as the predetermined threshold value.

In addition to the effects achieved by the above embodiments 9 or 10, the sound source control information generating apparatus according to another embodiment 11 of the present invention includes a ring buffer, capable of storing the second output value of a predetermined time, as the memory means. Thus, if the first output value with respect to the target struck head is obtained, whether the object is placed on the struck head can be distinguished by tracing back from the timing thereof.

An electronic percussion instrument according to another embodiment 12 or a sound source control information generating method according to yet another embodiment of the present invention achieves the same effects as any of the foregoing embodiments 1 to 11.

DESCRIPTION OF THE EMBODIMENTS

Figure 1:
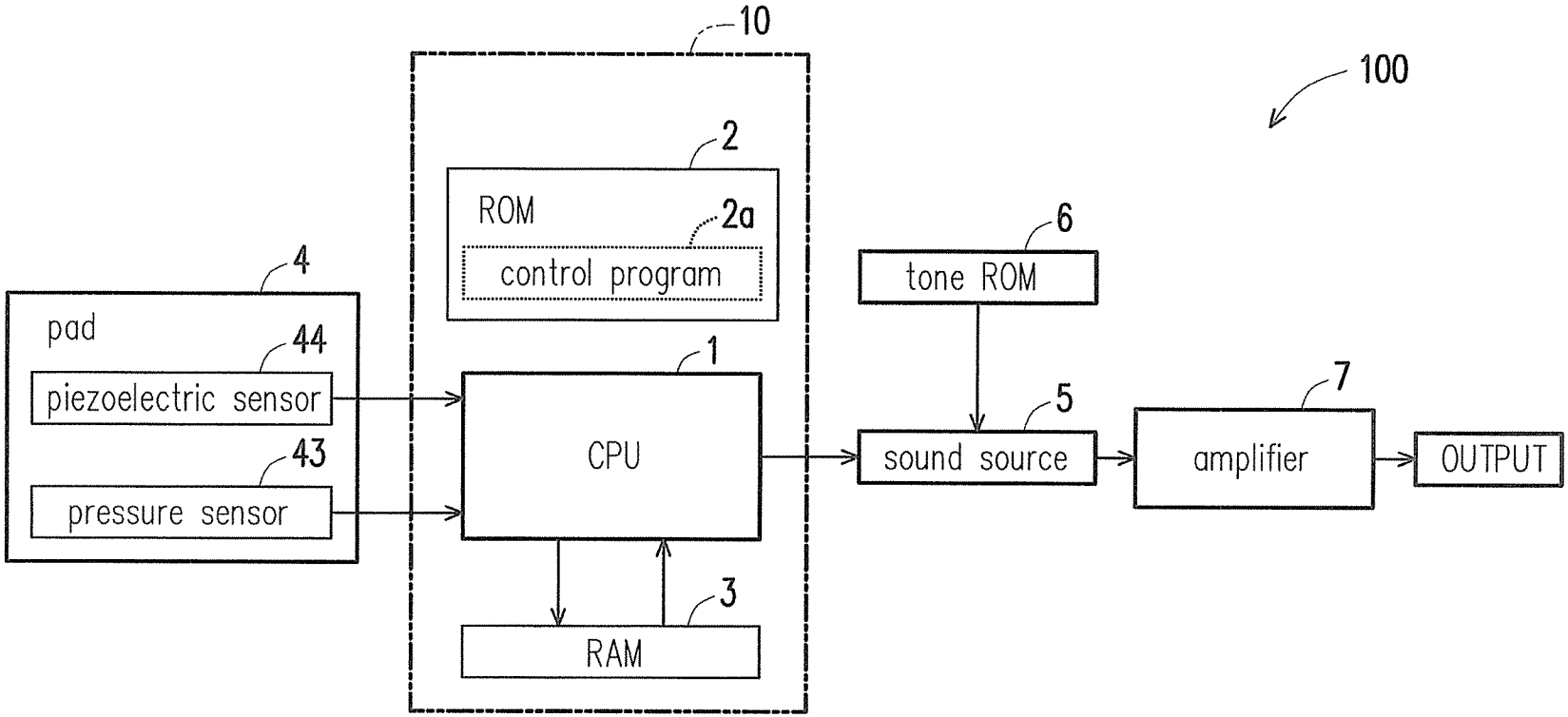
FIG. 1 is a block diagram showing an electrical configuration of an electronic percussion instrument.

Below exemplary embodiments of the present invention are described in detail with reference to the affixed figures. First, the first embodiment of the present invention is described hereinafter with reference to FIG. 1 to FIG. 5. FIG. 1 is a block diagram showing an electrical configuration of an electronic percussion instrument 100 as an embodiment of the present invention. The electronic percussion instrument 100 is an electronic drum, for example. The electronic percussion instrument 100 includes a CPU 1, a ROM 2, a RAM 3, a pad 4, a sound source 5, a tone ROM 6, and an amplifier 7.

The CPU 1 is a central control unit that controls each member of the electronic percussion instrument 100 according to fixed values and programs stored in the ROM 2 and data stored in the RAM 3, which are examples of the sound source control information generating method. The CPU 1 includes a built-in timer (not shown) that measures time by counting a clock signal.

Figure 3:
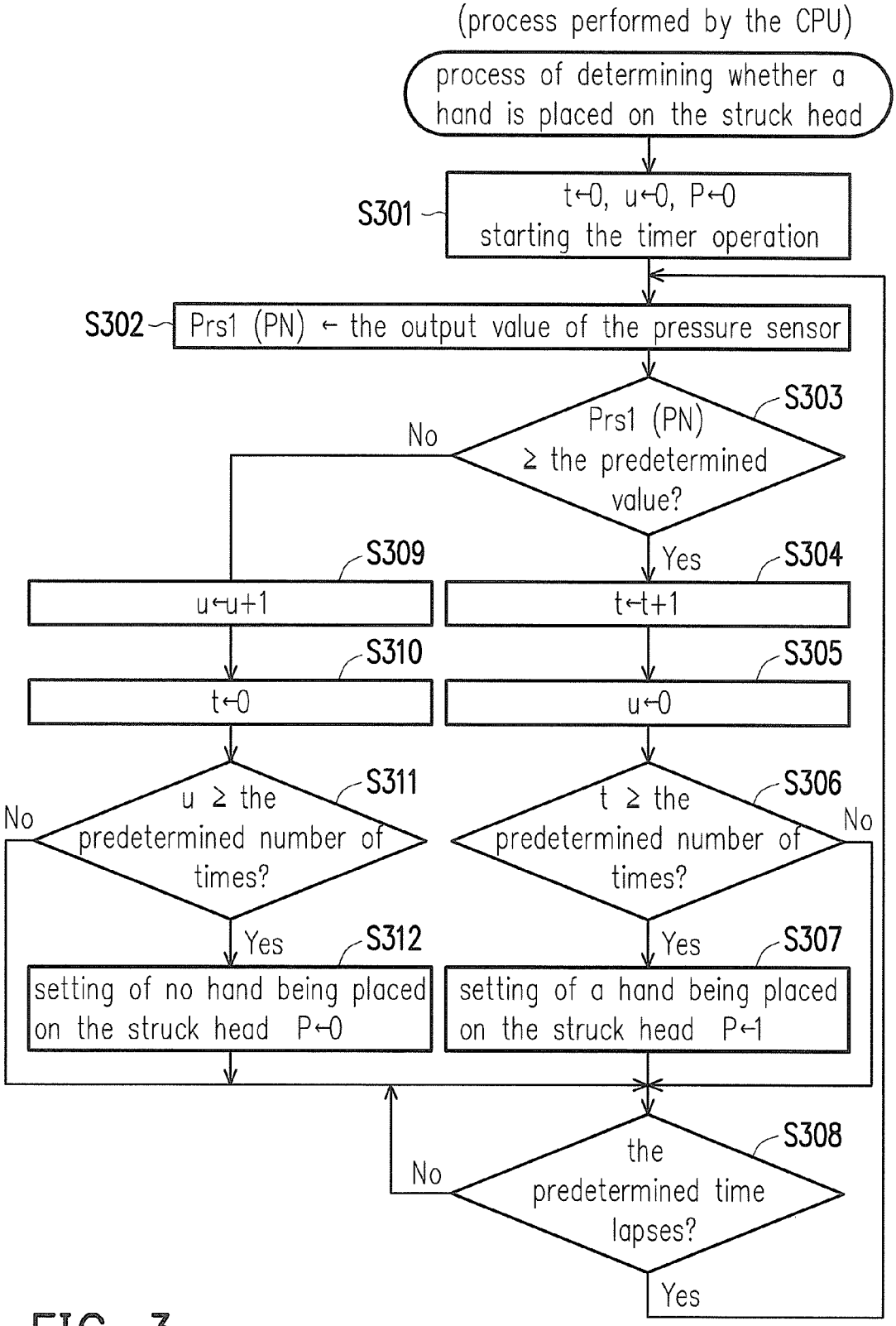
FIG. 3 is a flowchart showing a process of determining whether a hand is placed on a struck head.
Figure 4:
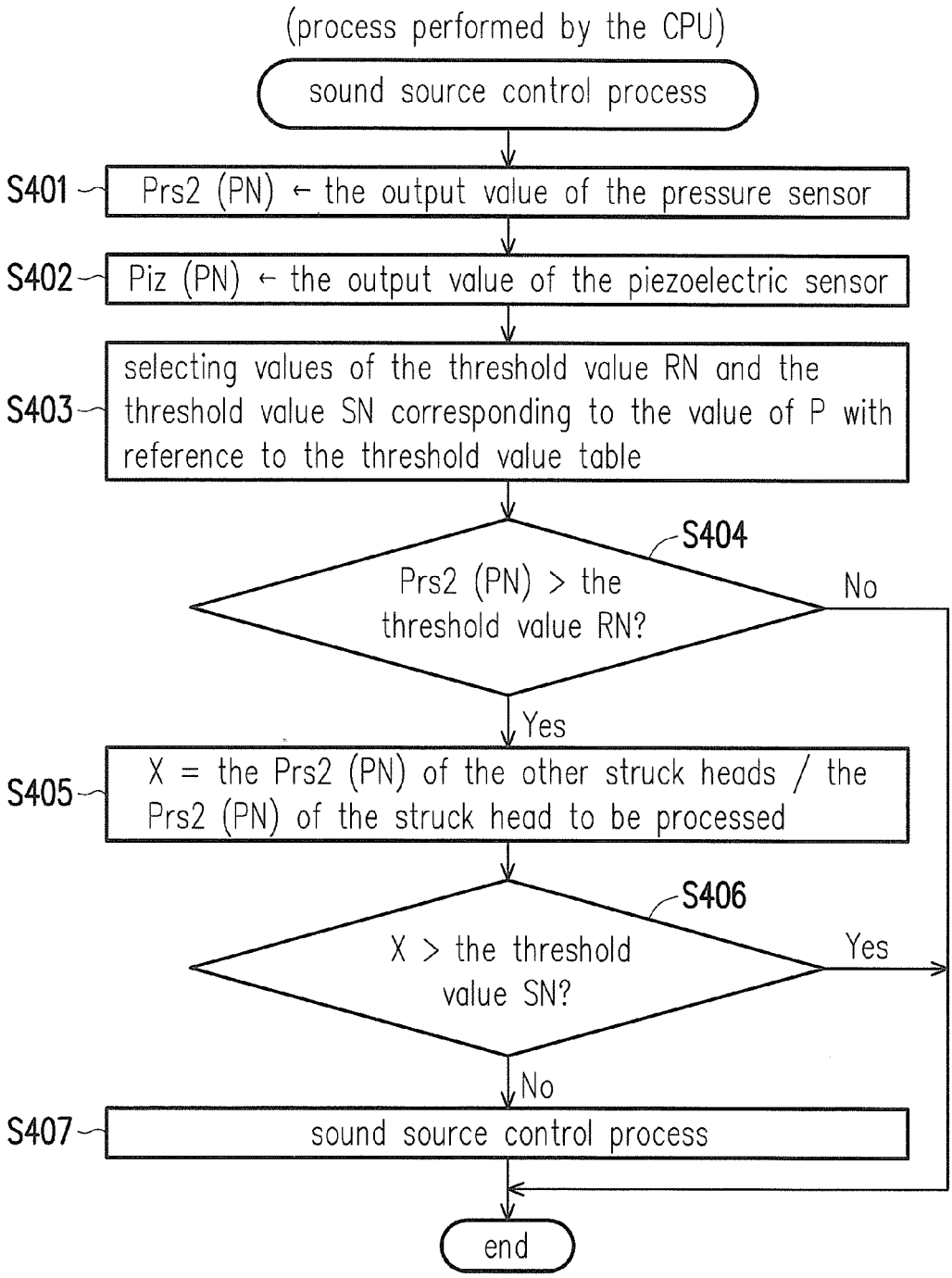
FIG. 4 is a flowchart showing a sound source control process.

The ROM 2 is a read-only memory that stores a control program 2*a* to be executed by the CPU 1 and various tables, such as a threshold value table which will be described later. The CPU 1 executes the processes as illustrated by the flowcharts of FIG. 3 and FIG. 4, which will be described later, based on the control program 2*a*. The RAM 3 is a random access memory that is used by a working area of the CPU 1, for example.

The CPU 1, the ROM 2, and the RAM 3 constitute a sound source control information generating apparatus 10 of the present invention. If a hand is placed on one of multiple struck heads 41 (see FIG. 2) of the pad 4 and the hand rebounds due to vibration transmitted from the other struck heads 41, the sound source control information generating apparatus 10 of this embodiment controls the sound source 5 not to generate the unintended sound caused by striking of the rebound. Details thereof will be provided later.

The pad 4 is provided for receiving striking on the struck head for electronic drum performance and includes a piezoelectric sensor 44 and a pressure sensor 43. In this embodiment, the pad 4 includes four struck heads 41*a*-41*d*, and the pressure sensor 43 is provided for the struck heads 41*a*-41*d* respectively. The detailed structure of the pad 4 will be described later with reference to FIG. 2A and FIG. 2B. Meanwhile, one piezoelectric sensor 44 is disposed on the back side of a case 40. The sound source 5 is a device that controls the tone or various effects of the generated sound in accordance with an instruction from the CPU 1. The tone ROM 6 is a read-only memory that stores tone data. The sound source 5 performs tone control by using the tone data stored in the tone ROM 6. The amplifier 7 is a device that amplifies a musical signal generated by the sound source 5, and outputs the amplified musical signal to a speaker system, etc. (not shown).

Figure 2A:
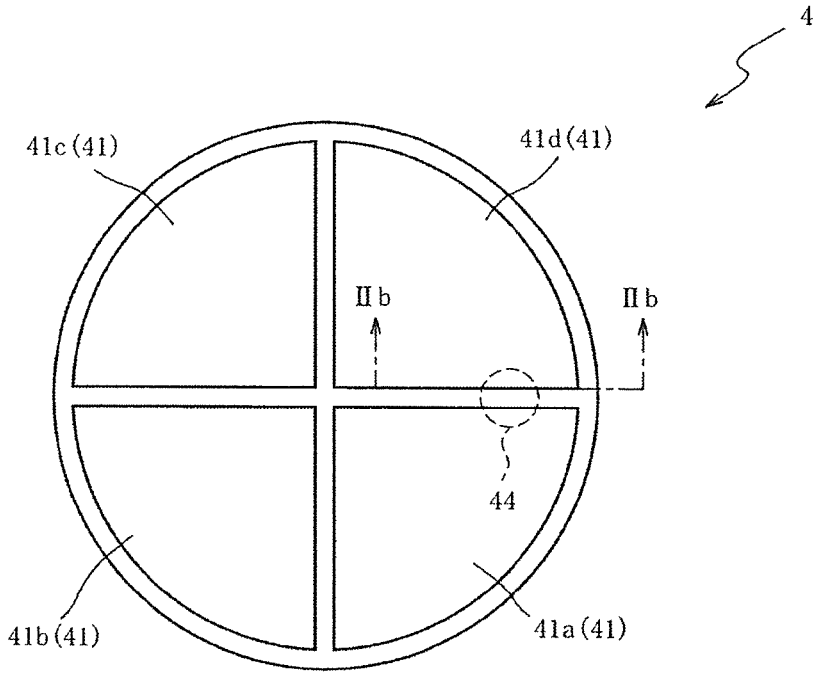
FIG. 2A is a schematic front view of a pad.
Figure 2B:
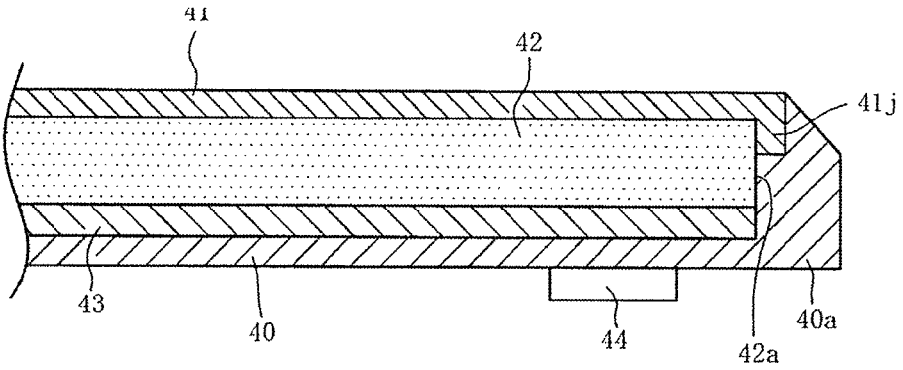
FIG. 2B is a schematic cross-sectional view of the pad taken along the line IIb-IIb of FIG. 2A.

FIG. 2A is a schematic front view of the pad 4. FIG. 2B is a schematic cross-sectional view of the pad 4 taken along the line IIb-IIb of FIG. 2A. The pad 4 is a device having a disc shape and includes the case 40 and the struck head 41 disposed on an upper side of the case 40, wherein the case 40 is a circular dish-shaped plate made of a rigid body, and the struck head 41 is composed of a circular rubber pad. In this embodiment, the struck head 41 includes four fan-shaped struck heads 41*a*-41*d*. On a lower (back) side of the struck head 41, a circular plate-shaped cushion material 42 and the pressure sensor 43 are held in a form of being tightly sandwiched by the struck head 41 and the case 40.

The cushion material 42 provides functions of adjusting the feeling of striking the struck head 41 to a comfortable degree with elasticity and attenuating the vibration of the striking to prevent the vibration from directly transmitting to the case 40 in a vertical downward direction of the struck head 41. The cushion material 42 attenuates the striking vibration when the struck head 41 is struck and meanwhile transmits the pressure applied on the struck head 41 by the striking to the pressure sensor 43.

When the struck head 41 is struck, the pressure sensor 43 detects the pressure received by the struck head 41 due to the striking, i.e. pressing against the struck head 41, and the pressure sensor 43 is disposed in a planar shape on the back side of the struck head 41. More specifically, the planar pressure sensor 43 is disposed independently on the back side of each of the four struck heads 41*a*-41*d*. Therefore, the pressure sensor 43 generates an output value independently for each of the struck heads 41*a*-41*d*. The "planar shape" may refer to an uninterrupted plane shape or a mesh (net) shape, for example, or the "planar shape" may also be a spiral shape as long as the pressure sensor 43 can detect the striking pressure and generate a single detection output when any part of the struck head is struck. In this embodiment, the pressure sensor 43 and the piezoelectric sensor 44 not only function as sensors for detecting the striking on the struck heads 41*a*-41*d* but also function as sensors for detecting whether an object, such as a hand, is placed on the struck heads 41*a*-41*d*.

An end portion 41*j* of the struck head 41 is fixed in a manner of being held by an edge portion 40*a* of the case 40 and an end portion 42*a* of the cushion material 42. On the back side of the case 40, the piezoelectric sensor 44 which serves as a vibration sensor, is attached on the side of the edge portion 40*a*. When the struck head 41 is struck, the striking vibration, which is transmitted to the edge portion 40*a* through the struck head 41, is transmitted to the case 40 through the edge portion 40*a* and reaches the piezoelectric sensor 44.

When the struck head 41 is struck, the vibration detected by the piezoelectric sensor 44 is mainly the vibration that is transmitted from the struck head 41 to the case 40 along the side of the edge portion 40*a* and then reaches the piezoelectric sensor 44. As mentioned above, the vibration transmitted in the vertical downward direction of the struck point is absorbed or attenuated by the cushion material 42, and most of the vibration is not transmitted to the piezoelectric sensor 44.

The piezoelectric sensor 44 is disposed at a location such that the length of a path of the striking vibration transmitted from the struck point to the piezoelectric sensor 44 varies depending on different struck points of the struck head 41. In this way, since the piezoelectric sensor 44 detects the striking vibration through the struck head 41 and the case 40, an output value generated by the piezoelectric sensor 44 when the edge side of the struck head 41 is struck is greater than an output value generated when the struck head 41 is struck near the center of the pad. In this embodiment, which struck head 41 is struck and to what level "the struck head 41 is struck" are detected based on the output of the piezoelectric sensor 44 and the output of the pressure sensor 43 as described above. In other words, the pressure sensor 43 and the piezoelectric sensor 44 function as striking sensors.

Next, the processes performed by the electronic percussion instrument 100 having the aforementioned configuration, or more specifically the CPU 1 of the sound source control information generating apparatus 10, are explained with reference to FIG. 3 and FIG. 4. First, FIG. 3 is a flowchart showing a process of determining whether a hand is placed on the struck head. The process is initiated when power is applied. The CPU 1 performs the process for each of the struck heads that constitute the struck head 41, i.e. the struck heads 41*a*-41*d* in this embodiment.

First, the CPU 1 initializes variables t, u, and P and sets these variables to 0 respectively, and starts a timer operation (S301). The variable t is for counting the number of times that the output value of the pressure sensor 43 is equal to or greater than a predetermined value. The variable u is for counting the number of times that the output value of the pressure sensor 43 is less than the predetermined value. The variable P indicates whether a hand is placed on the struck head 41. More specifically, if P=0, it indicates that no hand is placed on the struck head to be processed among the struck heads 41*a*-41*d*. On the other hand, if P=1, it indicates that a hand is placed on the struck head to be processed.

Then, the CPU 1 stores the output value of the pressure sensor 43 at that time in a register Prs1 (PN) corresponding to the struck head to be processed among the struck heads 41*a*-41*d* (S302). The PN is a variable for distinguishing the struck head that is to be processed. Any of the struck heads to be processed is assigned for each value of the PN. In this embodiment, there are four struck heads 41*a*-41*d* to be processed. Thus, the PN value is one of 1-4.

The CPU 1 determines whether the value of Prs1 (PN) is equal to or greater than the predetermined value (S303). If the CPU 1 determines that the value of Prs1 (PN) is equal to or greater than the predetermined value (S303: Yes), the CPU 1 adds 1 to the variable t (S304) and sets the variable u to 0 (S305). Next, the CPU 1 determines whether the variable t is equal to or greater than a predetermined number of times (S306). In this embodiment, a threshold value used in S306 is 21 times.

Then, if the CPU 1 determines that the variable t is less than the predetermined number of times (S306: No), the CPU 1 moves on to S308 and waits for a predetermined time to lapse (S308: No). In this embodiment, a threshold value used in S308 is 400 μsec. Thereafter, the CPU 1 returns to S302 when the predetermined time lapses (S308: Yes).

On the other hand, if the CPU 1 determines that the variable t is equal to or greater than the predetermined number of times (S306: Yes), the CPU 1 deems that a hand is placed on the struck head 41 to be processed, and sets the variable P to 1 (S307) and moves on to S308. In this embodiment, the variable P is set to 1 if the variable t, which counts the number of times that the value of Prs1 (PN) is equal to or greater than the predetermined value, reaches 21 in the process performed every 400 μsec. That is, if a period that the value of Prs1 (PN) is equal to or greater than the predetermined value reaches 8 msec, the CPU 1 deems that a hand is placed on the struck head 41 to be processed and sets the variable P to 1.

If the CPU 1 determines that the value of Prs1 (PN) is less than the predetermined value in S303 (S303: No), the CPU 1 adds 1 to the variable u (S309) and sets the variable t to 0 (S310). Next, the CPU 1 determines whether the variable u is equal to or greater than the predetermined number of times (S311). In this embodiment, a threshold value used in S311 is also 21 times, the same as the threshold value used in S306. However, the threshold value used in S311 is not necessarily the same as the threshold value used in S306.

Thereafter, if the CPU 1 determines that the variable u is less than the predetermined number of times (S311: No), the CPU 1 returns to S308. On the other hand, if the CPU 1 determines that the variable u is equal to or greater than the predetermined number of times (S311: Yes), the CPU 1 deems that no hand is placed on the struck head 41 to be processed, and sets the variable P to 0 (S312) and returns to S308. Thus, if the period that the value of Prs1 (PN) is less than the predetermined value reaches 8 msec, the CPU 1 deems that no hand is placed on the struck head 41 to be processed and sets the variable P to 0. Therefore, when the variable P is set to 1, even if the output value of the pressure sensor 43 suddenly becomes less than the predetermined value, the variable P remains 1 and does not change to 0. Accordingly, it is possible to prevent processing as if there were no hand despite that a hand is indeed placed on the struck head 41 to be processed.

FIG. 4 is a flowchart showing a sound source control process. This process is a process that controls the sound source 5 responsive to the output values of the pressure sensor 43 and the piezoelectric sensor 44 of the pad 4. The CPU 1 performs this process for each of the struck heads that constitute the struck head 41, i.e. the struck heads 41*a*-41*d* in this embodiment. This process is a timer interruption process that the CPU 1 performs periodically at a predetermined cycle. In this embodiment, a cycle of performing the sound source control process is 400 μsec.

The CPU 1 stores the output values of the pressure sensor 43 and piezoelectric sensor 44 at that time in a register Prs2 (PN) and a register Piz (PN) respectively (S401, S402). Then, the CPU 1 selects values of a threshold value RN and a threshold value SN corresponding to the current value of the variable P with reference to the threshold value table stored in the ROM 2 (S403). The threshold value table is as shown by the Table 1 below, which correlates the value of the variable P with the values of the threshold values RN and SN. The threshold value RN is for determining whether striking that triggers sound generation is made on the struck head 41 to be processed. The threshold value SN is for determining whether the striking that triggers sound generation on the struck head 41 to be processed is caused by a crosstalk from another struck head 41.

TABLE 1

| | No hand is placed P = 0 | A hand is placed P = 1 | |
|---|---|---|---|
| Threshold value RN | RNa | RNb | RNa < RNb |
| Threshold value SN | SNa | SNb | SNa < SNb |

According to the process of S403, the values of the threshold value RN and the threshold value SN, corresponding to whether a hand is placed on the struck head to be processed, are selected based on the value of the variable P by referring to the threshold value table above. More specifically, if the variable P=0, namely, no hand is placed on the struck head 41 to be processed, RNa is selected as the threshold value RN and SNa is selected as the threshold value SN. In contrast, if the variable P=1, namely, a hand is placed on the struck head 41 to be processed, RNb is selected as the threshold value RN and SNb is selected as the threshold value SN. In this embodiment, RNb and SNb are greater than RNa and SNa respectively. Thus, if a hand is placed on the struck head 41 to be processed, greater threshold value RN and threshold value SN are selected, as compared with the situation where no hand is placed on the struck head 41 to be processed.

Next, the CPU 1 determines whether the value of Prs2 (PN) is greater than the value selected as the threshold value RN (S404). If Prs2 (PN)≤the threshold value RN (S404: No), the CPU 1 deems that striking that triggers sound generation is not made on the struck head 41 to be processed and ends this process. In such a case, the sound source 5 does not generate a sound. On the other hand, if Prs2 (PN)>the threshold value RN (S404: Yes), the CPU 1 calculates a ratio X of the Prs2 (PN) of the other struck heads 41 to the Prs2 (PN) of the struck head 41 to be processed (S405).

The CPU 1 determines whether the obtained ratio X is greater than the value selected as the threshold value SN in S403 (S406). If X>the threshold value SN (S406: Yes), the CPU 1 deems that the striking that triggers sound generation on the struck head 41 to be processed is caused by the crosstalk from other struck heads 41 and ends this process. In such a case, the sound source 5 does not generate a sound. On the other hand, if X≤the threshold value SN (S406: No), the CPU 1 performs the sound source control process (S407) and ends this process. To be more specific, in S407, the CPU 1 outputs a volume parameter, etc., corresponding to a tone control parameter or a striking level to the sound source 5. In this embodiment, the striking level is a sum of Prs2 (PN), i.e. the output value of the pressure sensor 43, and Piz (PN), i.e. the output value of the piezoelectric sensor 44. The Prs2 (PN) and Piz (PN) may be weighted respectively by multiplying an appropriate coefficient.

Figure 5B:
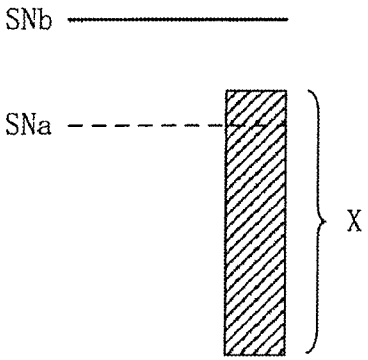
FIG. 5A and FIG. 5B are diagrams explaining effects achieved by a sound source control information generating apparatus.
Figure 5A:
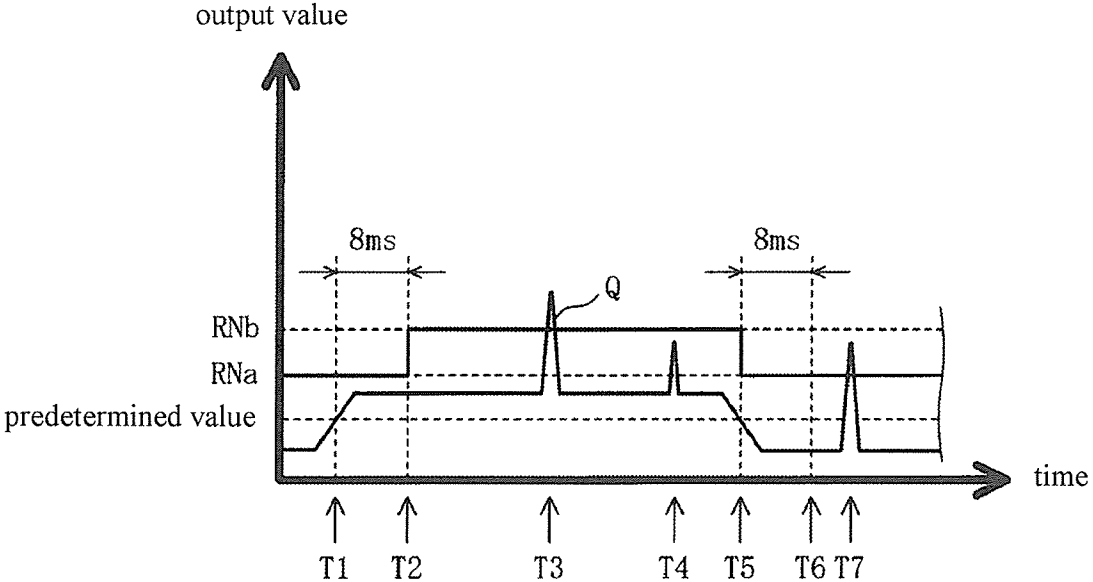

FIG. 5A and FIG. 5B are diagrams explaining effects achieved by the sound source control information generating apparatus 10 of this embodiment. FIG. 5A is a graph showing an example of a temporal variation Q of the output value of the pressure sensor 43 with respect to one struck head 41. In the graph of FIG. 5A, the horizontal axis represents time and the vertical axis represents the output value of the pressure sensor 43. According to the sound source control information generating apparatus 10 of this embodiment, as shown in FIG. 5A, the output value of the pressure sensor 43 becomes equal to or greater than the predetermined value at a time T1, and then starting from a time T2 when 8 msec has lapsed, the CPU 1 deems that a hand is placed on the struck head 41 and changes the value selected as the threshold value RN from RNa to RNb.

If no hand is placed on the struck head 41, namely, the threshold value RN is RNa, the output values at a time T3 and a time T4 are both determined as striking that triggers sound generation. In contrast thereto, if a hand is placed on the struck head 41, because RNb is selected as the threshold value RN in S403, the output value at the time T3 is determined as striking that triggers sound generation but the output value at the time T4 is not determined as striking that triggers sound generation.

Thereafter, at a time T5, the output value of the pressure sensor 43 becomes less than the predetermined value, and then starting from a time T6 when 8 msec has lapsed, the CPU 1 deems that no hand is placed on the struck head 41, or more specifically the hand placed on the struck head 41 is removed, and changes the value selected as the threshold value RN from RNb to RNa. The output value at a time T7 which comes after the time T6 is less than RNb but greater than RNa. Thus, it is determined as striking that triggers sound generation.

FIG. 5B is a diagram showing the relationship between the value of the X ratio and the threshold value SN. In the example of FIG. 5B, if the threshold value SN is SNa, the ratio X is greater than SNa. Therefore, the output value of the pressure sensor 43 corresponding to the ratio X is deemed as a result of crosstalk from the other struck heads 41 and does not trigger sound generation. On the other hand, if it is deemed that a hand is placed on the struck head and causes the threshold value SN to be changed to SNb, the ratio X is less than SNb. In such a case, the output value of the pressure sensor 43 corresponding to the ratio X is not deemed as a result of crosstalk from the other struck heads 41 and triggers sound generation.

As described above, according to the sound source control information generating apparatus 10 of this embodiment, if a hand is placed on the struck head, the threshold value RN and the threshold value SN are set higher in comparison with the case where no hand is placed on the struck head. Thus, the slight vibration on the struck head 41 to be processed due to striking on the other struck heads 41 can be ignored. Therefore, when the hand placed on the struck head 41 to be processed rebounds slightly due to the striking on the other struck heads 41, an unintended sound generated by the slight rebound can be prevented. In addition, for a case where the sound of the striking, even if resulting from a rebound, should be generated, the sound of the rebound of the hand on the struck head 41 to be processed can still be simulated based on the striking on the other struck heads 41.

Next, the second embodiment of the present invention is explained below with reference to FIG. 6. The first embodiment as described above provides a configuration that constantly monitors the output of the pressure sensor 43 and determines that a hand is placed on the struck head 41 when the output of the pressure sensor 43 is equal to or greater than the predetermined value over a predetermined time. In contrast, in the second embodiment, the output value of the pressure sensor 43 is stored in a ring buffer, and whether a hand is placed on the struck head 41 is determined based on the content stored in the ring buffer every time the sound source control process is performed. In the second embodiment, the same reference numerals are used to denote components the same as the first embodiment. Thus, detailed descriptions are not repeated hereinafter.

Figure 6A:
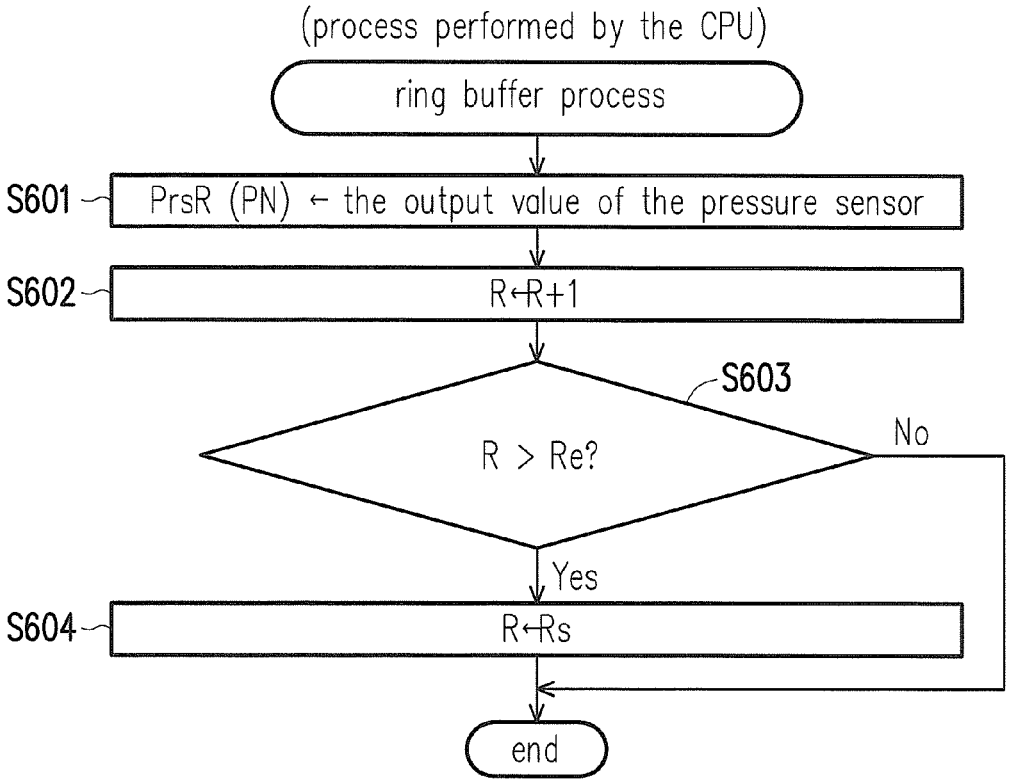
FIG. 6A and FIG. 6B are flowcharts respectively showing a ring buffer process and a sound source control process of the second embodiment.

FIG. 6A is a flowchart showing a ring buffer process. This process is a process that stores the output value of the pressure sensor 43 with respect to each of the struck heads 41*a*-41*d* in a ring buffer A (PN), not shown, provided in the RAM 3 corresponding to each of the struck heads 41*a*-41*d*. This process is a timer interruption process that the CPU 1 performs periodically at a predetermined cycle. The CPU 1 performs this process for each of the struck heads 41*a*-41*d* in this embodiment. In this embodiment, the cycle of performing the ring buffer process is 400 μsec. Moreover, in this embodiment, the ring buffer A (PN) used in this process is configured to retain 21 pieces of data. Thus, in this embodiment, the output values of the pressure sensor 43 with respect to each of the struck heads 41*a*-41*d* are retained in the ring buffer A (PN) over 8 msec.

When power is applied, the CPU 1 sets a timer time corresponding to the cycle of performing the ring buffer process as an initial setting. In addition, the CPU 1 inputs Rs as an address variable R in preparation for storing the output value of the pressure sensor 43 to the ring buffer A (PN). The address variable R indicates a current data input target address among addresses of the ring buffers A (PN). Rs is an initial address of the ring buffer A (PN).

The CPU 1 initiates the ring buffer process of FIG. 6A every time the timer time set in the initial setting lapses. In the ring buffer process, the CPU 1 stores the output value of the pressure sensor 43 at that time in PizR (PN) (S601). Then, the CPU 1 adds 1 to the address variable R for proceeding to the next data input target address (S602) in preparation for storing the output value of the pressure sensor 43 in the next process to be performed.

The CPU 1 determines whether the address indicated by the address variable R is an address outside an area of the ring buffer A (PN) (S603). More specifically, in S603, the CPU 1 determines whether the address variable R exceeds Re which is an end address of the ring buffer A (PN).

If the CPU 1 determines that the address variable R exceeds Re (S603: Yes), the CPU 1 substitute Rs for the address variable R (S604) and ends this process to return the data input target address to the beginning of the ring buffer A (PN). On the other hand, if the CPU 1 determines that the address variable R does not exceed Re (S603: No), this process is ended.

Figure 6B:
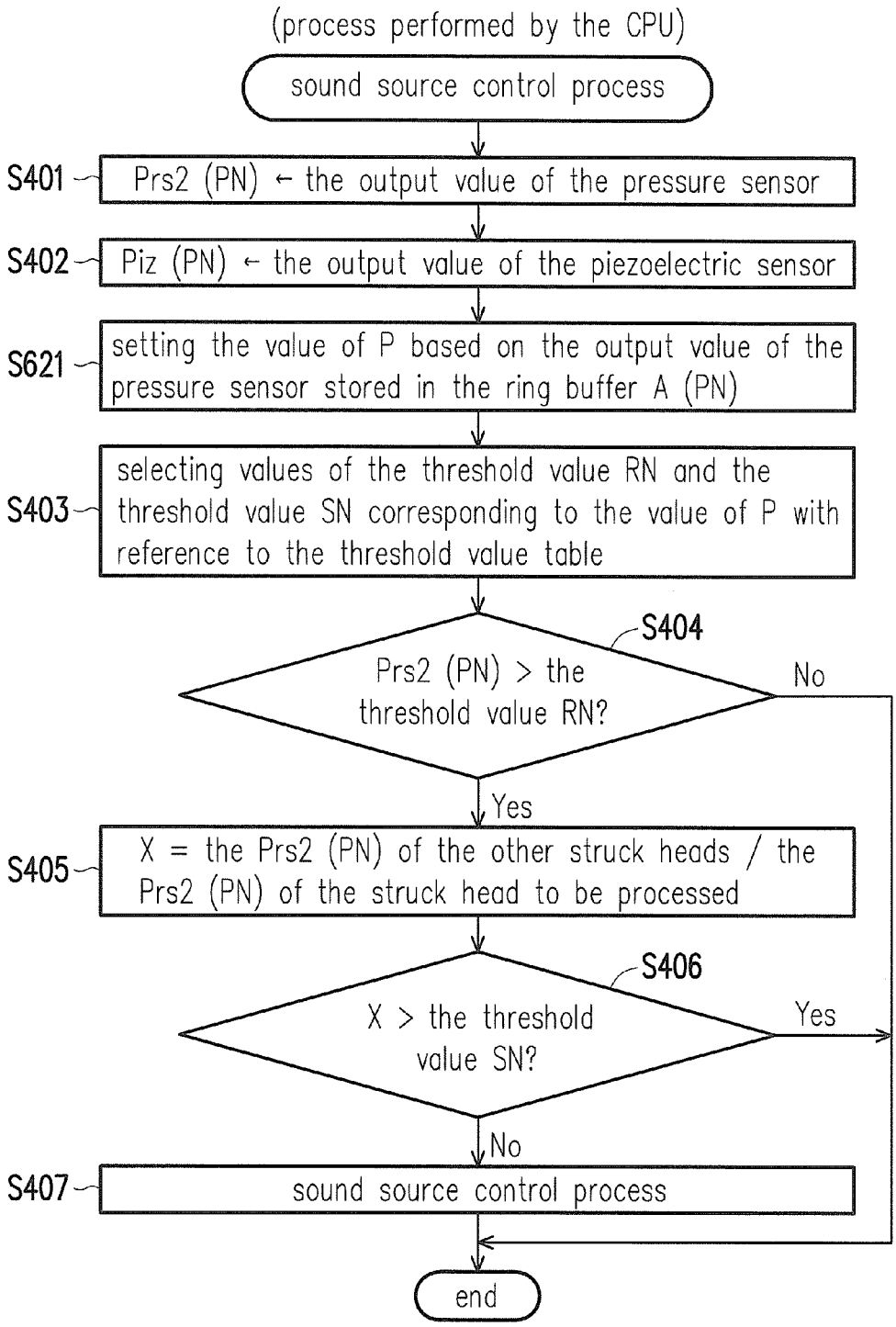

FIG. 6B is a flowchart showing a sound source control process of the second embodiment. The sound source control process of the second embodiment differs from the sound source control process (FIG. 4) of the first embodiment in that, before referring to the threshold value table, whether a hand is placed on the struck head 41 is determined based on the content stored in the ring buffer A (PN) corresponding to the struck head 41 to be processed, and the value of the variable P is set according to the determination.

In the sound source control process of the second embodiment, the CPU 1 sets the value of the variable P based on the output value of the pressure sensor 43 stored in the ring buffer A (PN) (S621) after performing S401 and S402. After S621, the CPU 1 performs S403-S407 and ends this process.

More specifically, in S621, the CPU 1 deems that a hand is placed on the struck head 41 to be processed and sets the variable P to 1 if the output values of the pressure sensor 43, which are obtained every 400 μsec 21 times, namely, over the 8 msec before the timing of performing this process of the current cycle, and stored in the ring buffer A (PN), are all equal to or greater than the predetermined value. On the other hand, if the output values of the pressure sensor 43 stored in the ring buffer A (PN) are all less than the predetermined value, the CPU 1 deems that no hand is placed on the struck head 41 to be processed and sets the variable P to 0. In this embodiment, even though the period for determining that a hand is placed on the struck head 41 to be processed and the period for determining that no hand is placed on the struck head 41 to be processed are both 8 msec, the former period and the latter period may be different periods. If the former period and the latter period are different, a retention period of the data in the ring buffer A (PN) is equal to or longer than the longer one of the period for determining that a hand is placed on the struck head 41 to be processed and the period for determining that no hand is placed on the struck head 41 to be processed.

When the sound source control information generating apparatus 10 of the second embodiment is used, since the output values of the pressure sensor 43 over 8 msec are stored in the ring buffer A (PN), whether a hand is placed on the struck head 41 to be processed can be determined by tracing the past using the content stored in the ring buffer A (PN) every 400 μsec when the sound source control process is performed.

In the above embodiments, the sound source control information generating apparatus 10 is an example of the sound source control information generating apparatus. The electronic percussion instrument 100 is an example of the electronic percussion instrument. The control program 2*a* is an example of the program. The struck head 41 is an example of the struck head. The sound source 5 is an example of the sound source means. The pressure sensor 43 and the piezoelectric sensor 44 are examples of the sensors that are capable of detecting striking on the multiple struck heads. The pressure sensor 43 is an example of the sensor that is capable of detecting the state when an object is placed on the multiple struck heads. The RAM 3 provided with the ring buffer A is an example of the memory means. The threshold value SN is an example of the predetermined threshold value and the first threshold value. The threshold value RN is an example of the predetermined threshold value and the second threshold value. RNa and SNa are examples of the reference value. RNb and SNb are examples of the value that is different from the reference value. The setting of the variable P to 1 is an example of the setting for using the value different from the reference value.

In the above embodiments, the CPU 1 that performs S401 is an example of the first acquisition means. The CPU 1 that performs S302 is an example of the second acquisition means. The CPU 1 that performs S407 is an example of the information generating means. The CPU 1 that performs S303 and S306 is an example of the first determining means. The CPU 1 that performs S303 and S311 is an example of the second determining means. The CPU 1 that performs S307, S312, and S621 is an example of the setting means. The ring buffer process of FIG. 6A is an example of the memory control means.

The above illustrates the present invention on the basis of the embodiments. However, it should be understood that the present invention is not limited to any of the embodiments, and various modifications or alterations may be made without departing from the spirit of the present invention.

The values given in the above embodiments are merely one of the examples, and it is certainly possible to adopt other values where appropriate. For example, in the above embodiments, when the period that the value of Prs1 (PN) is equal to or greater than the predetermined value reaches 8 msec, it is deemed that a hand is placed on the struck head 41 to be processed and the variable P is set to 1. However, the period for determining whether a hand is placed on the struck head 41 to be processed is not limited to 8 msec and may be other appropriate values as long as the period is longer than a scan time of the pressure sensor 43.

The above embodiments illustrate an electronic drum with the pad 4 as the electronic percussion instrument 100 provided with the sound source control information generating apparatus 10. However, the electronic percussion instrument 100 may also be a device including a housing and a touch panel that could be the struck head, such as a mobile terminal such as smart phone or mobile phone, a tablet terminal, a personal computer with a touch panel screen, and a music reproduction device, for example.

In the above embodiments, the CPU 1 is configured to perform the processes respectively shown by the flowcharts of FIG. 3, FIG. 4, and FIG. 6 according to the control program 2*a*. In the case where the electronic percussion instrument 100 is a device installed with an operating system such as Android (registered trademark) or iOS (registered trademark), an application program based on the installed operating system may be configured for the CPU 1 to perform the processes respectively shown by the flowcharts of FIG. 3, FIG. 4, and FIG. 6. In such a case, the application program is an example of the sound source control information generating method of the present invention.

In the above embodiments, the sound source control information generating apparatus 10 is configured to be built in the electronic percussion instrument 100 that includes the pad 4 and the sound source 5. However, the sound source control information generating apparatus 10 may also be separated from at least one of the pad 4 and the sound source 5. Moreover, in the above embodiments, the sound source control information generating apparatus 10 is composed of the CPU 1, the ROM 2, and the RAM 3 and is configured such that the CPU 1 performs the processes shown by the flowchart of FIG. 3, etc. However, the sound source control information generating apparatus 10 may be configured to include the sound source 5, and the processes, which are performed by the CPU 1 as described above, may be performed by a DSP in the sound source 5.

The above embodiments illustrate that the pressure sensor 43, which detects the pressing on the struck head 41, is used as the sensor for determining whether a hand is placed on the struck head 41. However, other sensors, such as a touch panel and a touch sensor, capable of detecting an object in contact with the struck head 41 may also be used. Alternatively, a configuration that combines the pressure sensor 43 with the touch panel or the touch sensor may also be used.

In the above embodiments, the pressure sensor 43 and the piezoelectric sensor 44 are configured to function as striking sensors. However, the pressure sensor 43 or the piezoelectric sensor 44 may be used solely as the striking sensor. Alternatively, a touch panel or a touch sensor may be used as the striking sensor. Moreover, in the above embodiments, the pressure sensor 41 is configured to serve as both the sensor for determining whether a hand is placed on the struck head 41 and the striking sensor. However, the sensor for determining whether a hand is placed on the struck head 41 and the striking sensor may be separate sensors.

In the above embodiments, in the process of FIG. 3, the configuration is to determine whether the output value of the pressure sensor 43 is equal to or greater than the predetermined value in S303 using only the output value of the pressure sensor 43. However, the present invention is not limited thereto, and the configuration may be to respectively determine whether the output values of the pressure sensor 43 and the piezoelectric sensor 44 are equal to or greater than the predetermined value. In a modified example, if the output values of the pressure sensor 43 and the piezoelectric sensor 44 are both equal to or greater than the predetermined value, it is highly possible that the struck head 41 is struck, and thus it is determined that no hand is placed on the struck head 41. In contrast, if the output value of the pressure sensor 43 is equal to or greater than the predetermined value while the output value of the piezoelectric sensor 44 is very small, it is determined that a hand is placed on the struck head 41. In this modified example, it is possible to perform determination based on one output value respectively from the pressure sensor 43 and the piezoelectric sensor 44 in a short period, for example.

In the above embodiments, the sound source 5 is controlled without considering the struck point of the struck head 41. However, the configuration may be to obtain the struck point of the struck head 41 and control the sound source 5 according to the struck point. For example, a reference point sensor output table as described in Japanese Patent Publication No. 2001-255871 may be provided to be used with the output values of the pressure sensor 43 and the piezoelectric sensor 44 for calculating the struck point of the struck head 41.

The above embodiments illustrate the configuration that does not perform S407 if Prs2 (PN)≤the threshold value RN or if the ratio X>the threshold value SN in the sound source control process of FIG. 4 and FIG. 6B. However, the configuration may be to output volume parameters to the sound source 5 for reducing the volume to 0 or making the volume very small.

In the above embodiments, the configuration is to dispose the threshold value table and select RNa and SNa as the threshold value RN and the threshold value SN respectively if no hand is placed on the struck head 41 (P=0) and select RNb and SNb as the threshold value RN and the threshold value SN respectively if a hand is placed on the struck head 41 (P=1). Instead of the above, the values of the threshold value RN and the threshold value SN used when a hand is placed on the struck head 41 may also be obtained by multiplying the values of the threshold value RN and the threshold value SN used when no hand is placed on the struck head 41 by a predetermined coefficient. A common coefficient may be assigned to all the struck heads, or different coefficients may be assigned to the struck heads respectively. Alternatively, threshold value tables may be independently and respectively provided for the case where a hand is placed on the struck head 41 and for the case where no hand is placed on the struck head 41, and the threshold value RN and the threshold value SN may be read from the threshold value tables respectively according to whether a hand is placed on the struck head 41.

The above embodiments illustrate the configuration that compares the ratio X of the Prs2 (PN) of the other struck heads 41 with respect to the Prs2 (PN) of the struck head 41 to be processed with the threshold value SN. However, the threshold value SN may also be compared with a difference Z obtained by subtracting the Prs2 (PN) of the struck head 41 to be processed from the Prs2 (PN) of the other struck heads 41 instead. In such a case, if the difference Z is less than the threshold value SN, the CPU 1 may perform the sound source control process (S407); if not, the CPU 1 may not perform the sound source control process (S407).

In the above embodiments, the configuration performs comparison between Prs2 (PN) and the threshold value RN and comparison between the ratio X and the threshold value SN. However, the configuration may perform only one of the foregoing comparisons. Nevertheless, it is preferable to perform the comparison between the ratio X and the threshold value SN.

The above embodiments illustrate the configuration that determines whether a hand is placed on the struck head 41 for each of the four struck heads 41*a*-41*d* and controls the values of the threshold value RN and the threshold value SN according to the determination result. However, the configuration may decide the struck head where a hand is to be placed, among the struck heads 41*a*-41*d*, in advance and then perform determination of whether the hand is placed and control of the values of the threshold value RN and the threshold value SN only for the decided struck head 41.

The above embodiments illustrate the configuration that sets the variable P to 1 if the Prs1 (PN), equal to or greater than the predetermined value, is obtained continuously over 8 msec in the process of FIG. 3. However, the configuration may still deem that a hand is placed on the struck head 41 and set the variable P to 1 if the number of times that Prs1 (PN) drops below the predetermined value in the period of 8 msec is negligible.

In the above embodiments, the object that is placed on the struck head 41 and rebounds due to the striking on the other struck heads 41 is a hand, for example. However, the present invention is also applicable for a case where a rod-shaped body or the like is placed on the struck head 41. In addition, the number of the struck heads 41 on which the object is placed is not limited to one.

The second embodiment illustrates the configuration that the output values of the pressure sensor 43 are stored in the ring buffer A. That is to say, the configuration retains the output values for the predetermined retention period. However, the configuration may associate the output value of the pressure sensor 43 with the time when the output value is obtained and store the output value in the RAM 3 at any time. In such a modified example, whether a hand is placed on the struck head 41 may be determined from the time when the sound source control process begins and from the time of each output value stored in the RAM 3.

In the above embodiments, the memory of the output values of the pressure sensor 43 is not limited to the RAM 3 and may be various types of recording media installed in a media slot provided in the electronic percussion instrument 100 or a memory device such as an external hard disk drive.

The features described in the first and second embodiments or the aforementioned modified examples may be combined as appropriate for implementation.

What is claimed is:

1. A sound source control information generating apparatus, comprising:

a first acquisition means obtaining a first output value which is an output value of a sensor serving to detect striking on each of a plurality of struck heads;

a second acquisition means obtaining a second output value which is an output value of a sensor serving to detect a state that an object is placed on each of the struck heads; and an information generating means, wherein if the first output value with respect to one struck head is obtained through the first acquisition means, the one struck head serves as a target struck head, and the information generating means generates information for controlling a sound source means such that a sound generation process performed by the sound source means differs according to whether the first output value obtained with respect to the target struck head or a value corresponding to the first output value is greater than a predetermined threshold value, wherein the information generating means (CPU):

uses a value (RNb, SNb) different from a reference value (RNa, SNa) as the predetermined threshold value (SN, RN) if the second output value (Prs1(PN)), equal to or greater than a predetermined value, obtained through the second acquisition means is obtained at least over a first period before a timing that the first output value (Prs2 (PN)) is obtained through the first acquisition means, and uses the reference value (RNa, SNa) as the predetermined threshold value (SN, RN) if the second output value (Prs1(PN)), equal to or greater than the predetermined value, obtained through the second acquisition means is not obtained at least over the first period before the timing.

2. The sound source control information generating apparatus according to claim 1, wherein a value corresponding to the first output value is a ratio of the first output value obtained with respect to the other struck heads, other than the target struck head, through the first acquisition means to the first output value obtained with respect to the target struck head through the first acquisition means, or a difference obtained by subtracting the first output value obtained with respect to the target struck head through the first acquisition means from the first output value obtained with respect to the other struck heads through the first acquisition means, and the information generating means generates the information according to whether the ratio or the difference is greater than a first threshold value which serves as the predetermined threshold value for comparison with the ratio or the difference.

3. The sound source control information generating apparatus according to claim 2, wherein the information generating means does not generate the information such that the sound source means does not perform the sound generation process if determining that the ratio or the difference is greater than the first threshold value.

4. The sound source control information generating apparatus according to claim 2, wherein the information generating means generates the information according to whether the ratio or the difference is greater than the first threshold value and whether the first output value obtained with respect to the target struck head is greater than a second threshold value which serves as the predetermined threshold value for comparison with the first output value.

5. The sound source control information generating apparatus according to claim 4, wherein the information generating means does not generate the information such that the sound source means does not perform the sound generation process if the first output value obtained with respect to the target struck head is less than the second threshold value which serves as the predetermined threshold value for comparison with the first output value.

6. The sound source control information generating apparatus according to claim 4, wherein the information generating means determines whether the ratio or the difference is greater than the first threshold value which serves as the predetermined threshold value for comparison with the ratio or the difference if the first output value obtained with respect to the target struck head is greater than the second threshold value which serves as the predetermined threshold value for comparison with the first output value.

7. The sound source control information generating apparatus according to claim 6, wherein the information generating means does not generate the information such that the sound source means does not perform the sound generation process if determining that the ratio or the difference is greater than the first threshold value.

8. The sound source control information generating apparatus according to claim 6, wherein the information generating means generates the information such that the sound generation process is performed by the sound source means if determining that the ratio or the difference is less than the first threshold value.

9. The sound source control information generating apparatus according to claim 1, wherein the information generating means:

generates the information according to whether the first output value obtained with respect to the target struck head is greater than the second threshold value which serves as the predetermined threshold value for comparison with the first output value.

10. The sound source control information generating apparatus according to claim 9, wherein the information generating means does not generate the information such that the sound source means does not perform the sound generation process if the first output value obtained with respect to the target struck head is less than the second threshold value for comparison with the first output value.

11. The sound source control information generating apparatus according to claim 9, wherein the information generating means obtains the value corresponding to the first output value, which is the ratio of the first output value obtained with respect to the other struck heads, other than the target struck head, through the first acquisition means to the first output value obtained with respect to the target struck head through the first acquisition means, or the difference obtained by subtracting the first output value obtained with respect to the target struck head through the first acquisition means from the first output value obtained with respect to the other struck heads through the first acquisition means if the first output value obtained with respect to the target struck head is greater than the second threshold value for comparison with the first output value.

12. The sound source control information generating apparatus according to claim 11, wherein the information generating means:

generates the information such that the sound generation process is performed by the sound source means if the first output value obtained with respect to the target struck head or the value corresponding to the first output value is greater than the predetermined threshold value, and does not generate the information such that the sound source means does not perform the sound generation process if the first output value obtained with respect to the target struck head or the value corresponding to the first output value is equal to or less than the predetermined threshold value.

13. The sound source control information generating apparatus according to claim 1, wherein the information generating means:

generates the information for the sound source means to perform the sound generation process of generating a sound with respect to the target struck head at a level corresponding to the first output value obtained with respect to the target struck head if the first output value obtained with respect to the target struck head or the value corresponding to the first output value is greater than the predetermined threshold value, and generates the information for the sound source means to perform the sound generation process of generating a sound with respect to the target struck head at a level smaller than the level corresponding to the first output value obtained with respect to the target struck head if the first output value obtained with respect to the target struck head or the value corresponding to the first output value is equal to or less than the predetermined threshold value.

14. The sound source control information generating apparatus according to claim 1, comprising:

a first determining means determining whether the second output value, equal to or greater than the predetermined value, obtained through the second acquisition means is obtained over the first period respectively for a part of or all of the struck heads; and a setting means performing setting for using the value different from the reference value as the predetermined threshold value for the struck head which is a target of the determination if the first determining means determines that the second output value, equal to or greater than the predetermined value, is obtained over the first period, wherein the information generating means:

uses the value different from the reference value as the predetermined threshold value if the setting for using the value different from the reference value is made, and uses the reference value as the predetermined threshold value if the setting for using the value different from the reference value is not made.

15. The sound source control information generating apparatus according to claim 14, comprising:

a second determining means determining whether the second output value, less than the predetermined value, obtained through the second acquisition means is obtained over a second period that is the same as or different from the first period respectively for a part of or all of the struck heads, wherein the setting means cancels the setting for using the value different from the reference value for the struck head which is the target of the determination if the second determining means determines that the second output value, less than the predetermined value, is obtained over the second period.

16. The sound source control information generating apparatus according to claim 1, comprising:

a memory control means storing the second output value obtained through the second acquisition means in a memory means with respect to a part of or all of the struck heads over a predetermined memory period which is at least the first period; and a setting means performing the setting for using the value different from the reference value for the target struck head, based on the second output value stored in the memory means with respect to the target struck head, if the second output value, equal to or greater than the predetermined value, obtained through the second acquisition means is obtained over the first period before the timing that the first output value is obtained through the first acquisition means, when the first output value with respect to the target struck head is obtained through the first acquisition means, wherein the information generating means:

uses the value different from the reference value as the predetermined threshold value if the setting for using the value different from the reference value is made, and uses the reference value as the predetermined threshold value if the setting for using the value different from the reference value is not made.

17. The sound source control information generating apparatus according to claim 16, wherein the setting means cancels the setting for using the value different from the reference value for the target struck head, based on the second output value stored in the memory means with respect to the target struck head, if the second output value, less than the predetermined value, obtained through the second acquisition means is obtained over a second period within the predetermined memory period before the timing that the first output value is obtained through the first acquisition means, when the first output value with respect to the target struck head is obtained through the first acquisition means, wherein the second period is the same as or different from the first period.

18. The sound source control information generating apparatus according to claim 16, comprising a ring buffer, serving to store the second output value of the predetermined memory period, as the memory means.

19. An electronic percussion instrument, comprising:

the sound source control information generating apparatus of claim 1;

the plurality of struck heads; and the sound source means.

20. A sound source control information generating method, comprising:

using a first acquisition means to obtain a first output value which is an output value of a sensor serving to detect striking on each of a plurality of struck heads;

using a second acquisition means to obtain a second output value which is an output value of a sensor serving to detect a state that an object is placed on each of the struck heads, and if the first output value with respect to one struck head is obtained through the first acquisition means, the one struck head serves as a target struck head, using an information generating means to generate information for controlling a sound source means such that a sound generation process performed by the sound source means differs according to whether the first output value obtained with respect to the target struck head or a value corresponding to the first output value is greater than a predetermined threshold value, wherein the information generating means (CPU):

uses a value (RNb, SNb) different from a reference value (RNa, SNa) as the predetermined threshold value (SN, RN) if the second output value (Prs1(PN)), equal to or greater than a predetermined value, obtained through the second acquisition means is obtained at least over a first period before a timing that the first output value (Prs2 (PN) is obtained through the first acquisition means, and uses the reference value (RNa, SNa) as the predetermined threshold value (SN, RN) if the second output value (Prs1(PN)), equal to or greater than the predetermined value, obtained through the second acquisition means is not obtained at least over the first period before the timing.

* * * * *